US009779844B2

(12) United States Patent
Arai et al.

(10) Patent No.: US 9,779,844 B2
(45) Date of Patent: Oct. 3, 2017

(54) CONTAINMENT CASK FOR RADIOACTIVE MATERIAL

(71) Applicant: HITACHI ZOSEN CORPORATION, Osaka-shi, Osaka (JP)

(72) Inventors: Hiroaki Arai, Osaka (JP); Satoshi Ashida, Osaka (JP); Koji Kitamura, Osaka (JP); Jyun Okada, Osaka (JP); Toki Ma, Osaka (JP)

(73) Assignee: HITACHI ZOSEN CORPORATION, Osaka (JP)

( * ) Notice: Subject to any disclaimer, the term of this patent is extended or adjusted under 35 U.S.C. 154(b) by 0 days.

(21) Appl. No.: 15/172,806

(22) Filed: Jun. 3, 2016

(65) Prior Publication Data

US 2016/0284431 A1 Sep. 29, 2016

Related U.S. Application Data

(63) Continuation of application No. PCT/JP2014/078044, filed on Oct. 22, 2014.

(30) Foreign Application Priority Data

Dec. 6, 2013 (JP) ..... 2013-253450

(51) Int. Cl.
*G21F 5/06* (2006.01)
*G21F 5/008* (2006.01)
(Continued)

(52) U.S. Cl.
CPC ..... *G21F 5/008* (2013.01); *G21F 5/06* (2013.01); *G21F 5/10* (2013.01); *G21F 9/36* (2013.01)

(58) Field of Classification Search
USPC ..... 250/505.1, 506.1, 507.1, 515.1, 516.1, 250/518.1, 519.1
See application file for complete search history.

(56) References Cited

U.S. PATENT DOCUMENTS 3,732,423 A * 5/1973 Peterson ..... G21F 5/005 250/506.1
5,641,970 A * 6/1997 Taniuchi ..... G21F 5/10 250/506.1
(Continued)

FOREIGN PATENT DOCUMENTS

JP S57-179798 A 11/1982
JP 61-198099 A 9/1986
(Continued)

OTHER PUBLICATIONS

International Search Report, and English language translation thereof, in corresponding International Application No. PCT/JP2014/078044, dated Dec. 16, 2014, 3 pages.
(Continued)

*Primary Examiner* — Nicole Ippolito
(74) *Attorney, Agent, or Firm* — Brinks Gilson & Lione

(57) ABSTRACT

To provide a containment cask for storage or transport of radioactive material, without employing a homogenization treatment. Pouring a molten lead between an inner shell 2 and an intermediate shell 3 to serve as a gamma ray shielding material, allowing the lead to cool, and subsequently, filling either one or both of a first void layer 9*a* formed at a boundary between the inner shell 2 and the poured lead 5*a* or a second void layer 9*b* formed at a boundary between the intermediate shell 3 and the poured lead 5*a*, using a low melting point metal 10 in a closely adhering state. To provide the cask 1 with a good heat-dissipating effect, by filling the void layers 9*a*, 9*b* that prevent the cask 1 from dissipating heat, with the low melting point metal 10 that has a superb thermal conductivity.

13 Claims, 7 Drawing Sheets

(51) Int. Cl.
*G21F 9/36* (2006.01)
*G21F 5/10* (2006.01)

(56) References Cited

U.S. PATENT DOCUMENTS

| | | | | |
|---|---|---|---|---|
| 5,887,042 | A * | 3/1999 | Akamatsu | G21F 1/085 250/506.1 |
| 2015/0325321 | A1* | 11/2015 | Helle | G21F 5/12 250/506.1 |

FOREIGN PATENT DOCUMENTS

| | | | |
|---|---|---|---|
| JP | H06-75093 | A | 3/1994 |
| JP | 07-027896 | A | 1/1995 |
| JP | 2008-076270 | A | 4/2008 |

OTHER PUBLICATIONS

English language translation of International Preliminary Report on Patentability in corresponding International Application No. PCT/JP2014/078044, dated Jun. 16, 2016, 6 pages.

* cited by examiner

CONTAINMENT CASK FOR RADIOACTIVE MATERIAL

This application is a continuation application of PCT/JP2014/78044 having an international filing date of Oct. 22, 2014, which claims priority to JP2013-253450 filed Dec. 6, 2013, the entire contents of both of the application are incorporated herein by reference.

TECHNICAL FIELD

The present invention relates to a containment cask (container) for radioactive material such as spent nuclear fuel discharged from a nuclear power plant or the like, the cask being able to hold the spent fuel for the purpose of storage or for the purpose of transport.

BACKGROUND ART

A cask used, for example, when transporting a radioactive material such as a spent nuclear fuel, must have a structure that efficiently dissipates heat generated by the radioactive material stored inside the cask to the outside, and that also shields gamma rays and neutrons emitted from the radioactive material so that they do not escape to the outside.

According to Patent Reference 1, for example, there is disclosed a prior art cask for transporting radioactive material that has a lead layer serving as a gamma ray shielding material interposed between a stainless steel inner shell and a steel intermediate shell disposed on the outer side of the inner shell. The cask according to Patent Reference 1 is also filled with a silicone rubber that serves as a neutron shield and is interposed between the intermediate shell and a steel outer shell disposed on the outer side of the intermediate shell.

Typically, such a multilayer lead cask is a cylinder with a three-layer structure (in the following, the structure on the innermost side is referred to as an "inner shell"; the structure on the outermost side is referred to as an "outer shell"; and the structure between the "inner shell" and the "outer shell" is referred to as an "intermediate shell"). A lead layer with outstanding gamma ray shielding properties is formed between the metallic inner shell and the metallic intermediate shell by pouring molten lead between the inner shell and the intermediate shell, and allowing the lead to solidify. This ensures a shielding capability against gamma rays, while forming an enclosure that is as thin as possible. The prior art technology according to Patent Reference 1 is an example of a method of forming a lead layer in a casting process involving a pouring of molten lead.

However, when a lead layer is formed between the steel shells of a two-layer structure, voids readily form at the boundary between the inner shell and the poured lead, or at the boundary between the intermediate shell and the poured lead, simply by pouring molten lead between the inner shell and the intermediate shell. If gases are present inside these voids, there are some cases in which the state is nearly that of a virtual vacuum, but in any case, when such voids (referred to below as "void layers," irrespective of the presence or absence of gases) exist, the heat-dissipating effect of the cask is significantly reduced. For this reason, if the cask is used without removing such void layers, the internal temperature of the cask exceeds a hypothetically allowable temperature, resulting in a hazardous state.

Patent Reference 2 was proposed to prevent the formation of such void layers, by employing what is generally referred to as a "homogenization treatment" before pouring the molten lead between the inner shell and the intermediate shell, so as to enhance adhesion between the lead layer and the steel shells.

In the past, homogenization treatment was employed by heating lead with a burner to melt it so as to create an alloy layer, while causing the lead layer to adhere more closely to the alloy layer and successively increase the thickness. However, the object of the manufacturing method disclosed in Patent Reference 2 was to improve the adhesion obtained in homogenization treatment by forming a vitrifiable lead-tin based thin-film. Specifically, the homogenization treatment according to Patent Reference 2 was implemented with the following sequence of steps: (1) A washing treatment step in which adhering matter, greasy components, and the like are removed from the external surface of the inner shell by degreasing, to produce a clean state; (2) A solvent application step in which the steel sheet surface is heated with a burner to a temperature on the order of 230-270° C., and after the surface reaches a specified temperature, a flux which is a solvent that improves wettability is applied; (3) A vitrifiable material application step in which the vitrifiable lead-tin based material is uniformly applied to the surface by dissolving it and dropping it onto the surface immediately after solvent application; and (4) A thin-film formation step in which the system is cooled for a while after solvent application, the inner surface (the side that holds the radioactive material) of the inner shell is reheated with a burner, the temperature is raised to 180-250° C., and the floating vitrifiable material is wiped off with a heat-resistant cloth, forming a thin-film of vitrifiable material on the exterior surface of the inner shell.

However, homogenization treatment that requires steps such as (1) to (4) has a problem in that because it is accomplished almost entirely by manual labor performed by highly experienced and highly skilled workers, it is very inefficient, it takes an extended period of time to manufacture the cask, and the manufacturing cost is high.

In addition, due to the fact that it is not possible to always prevent the formation of void layers when the above-described homogenization treatment is employed, there is a need to inspect the cask after it is manufactured to see whether or not there are void layers, and the inspection process itself takes a lot of work.

The present invention was devised with consideration given to the above-described problem of the formation of void layers at the boundary between the inner shell and the poured lead, or at the boundary between the intermediate shell and the poured lead. The object of the present invention is to provide a containment cask for radioactive material that makes it possible to shorten the manufacturing time and to reduce the manufacturing cost by completely eliminating homogenization treatment, or, even if homogenization treatment is employed, to reduce the scope of its use by half.

PRIOR ART REFERENCES

Patent References

Patent Reference 1: Japanese Patent Application Kokai Publication No. S61-198099

Patent Reference 2: Japanese Patent Application Kokai Publication No. H07-27896

SUMMARY OF THE INVENTION

Problems to be Solved by the Invention

The problems that the present invention aims to solve are that because prior art containment casks for radioactive material assumed the use of homogenization treatment, an extended period of time was needed to manufacture the cask, and the manufacturing cost also increased.

Means for Solving these Problems

The present invention solves these problems by providing a containment cask for a radioactive material comprising:

a metallic inner shell;

a metallic intermediate shell disposed on an outer side of the inner shell;

an outer shell disposed so as to cover an outer side of the intermediate shell;

lead solidified from a molten lead poured between the inner shell and the intermediate shell to serve as a gamma ray shielding material; and a low melting point metal filled in either one or both of (i) a first void layer formed at a boundary between the inner shell and the solidified lead or (ii) a second void layer formed at a boundary between the intermediate shell and the solidified lead.

Advantageous Effects of the Invention

According to the construction of the present invention, the void layers that prevent the cask from dissipating heat are filled with a low melting point metal that has a thermal conductivity surpassing that of air that is present in the void layers, for example. In other words, the concept of the present invention is to provide the cask with a good heat-dissipating effect, and to prevent the temperature within the cask from rising. This is achieved by filling the void layers with a low melting point metal in a closely adhering state after the void layers are formed.

The containment cask for radioactive material according to the present invention is able to shorten the manufacturing time and to reduce the manufacturing cost by eliminating homogenization treatment altogether, or, if homogenization treatment is used, to employ it only on the outer surface of the inner shell or only on the inner surface of the intermediate shell.

In the present invention, the term "low melting point metal" refers not only to a pure metal formed from a single metallic element, but also includes alloys. Use of alloys is not limited to alloys formed from a plurality of metallic elements, but also metal-like compounds formed from metallic elements and non-metallic elements.

BRIEF DESCRIPTION OF THE DRAWINGS

FIG. 1A is a partially cut-away view as seen from a planar orientation; and FIG. 1B is a partially cut-away view as seen from a lateral orientation.

FIG. 2A is a drawing illustrating a state immediately after solidification of the lead poured between the inner shell and the intermediate shell; and FIG. 2B is a drawing illustrating a state resulting from filling the space between the first void layer and the second void layer with a low melting point metal.

FIG. 3A is a partially cut-away view as seen from a planar orientation; and FIG. 3B is a partially cut-away view as seen from a lateral orientation.

FIG. 4A is a drawing illustrating a state immediately after solidification of the lead poured between the inner shell and the intermediate shell; and FIG. 4B is a drawing illustrating a state resulting from filling a void layer formed on the intermediate shell side without the presence of a homogenization-treated portion.

FIG. 5A is a drawing illustrating a state immediately after solidification of the lead poured between the inner shell and the intermediate shell; and FIG. 5B is a drawing illustrating a state resulting from filling a void layer formed on the inner shell side without the presence of a homogenization-treated portion.

FIG. 6A is a partially cut-away view as seen from a planar orientation; and FIG. 6B is a partially cut-away view as seen from a lateral orientation.

FIG. 7A is a drawing illustrating a state immediately after insertion of formed lead bodies into a space between the inner shell and the intermediate shell; and FIG. 7B is a drawing illustrating a state in which a void layer is filled with a low melting point metal.

DETAILED DESCRIPTION OF THE PREFERRED EMBODIMENTS

Figure 1A:
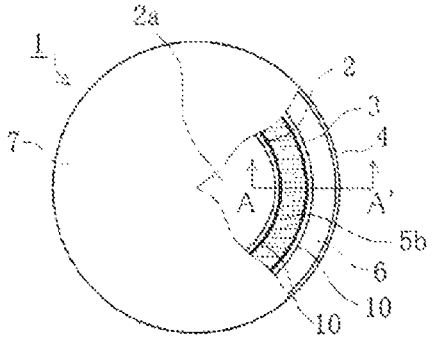
FIGS. 1A and 1B are drawings illustrating the structure of the cask according to Example 1.

Several embodiments of the containment cask for radioactive materials according to the present invention (referred to below simply as a "cask") are described in detail with reference to the appended drawings. A cask according to Example 1 illustrated in FIGS. 1A and 1B has the following construction.

A cask 1 is a cylindrical container that is able to hold a radioactive material such as a spent nuclear fuel for the purpose of storage or for the purpose of transport. The cask 1 has a cylindrical inner shell 2, a cylindrical intermediate shell 3 disposed on an outer side of the inner shell 2, as well as an outer shell 4 disposed so as to cover an outer side of the intermediate shell. The inner shell 2, the intermediate shell 3, and the outer shell 4 are arranged so that the centers of each of the cylindrical shells are positioned coaxially. Heat radiating fins (not pictured) are attached to the outer shell 4.

A lead layer 5*b* is formed as a gamma ray shielding material in a space between the inner shell 2 and the intermediate shell 3, to prevent gamma rays emitted from a radioactive material from escaping to outside of the cask 1. In addition, a space between the intermediate shell 3 and the outer shell 4 is filled with a neutron shielding material 6 formed from a material such as silicone rubber, for example.

A cover 7 that freely opens and closes is provided at the upper end of the cask 1. A holding member 2*a* that is able to hold radioactive material is provided inside the inner shell 2. The lower end of the cask 1 is sealed shut with a bottom plate 8.

Figure 1B:
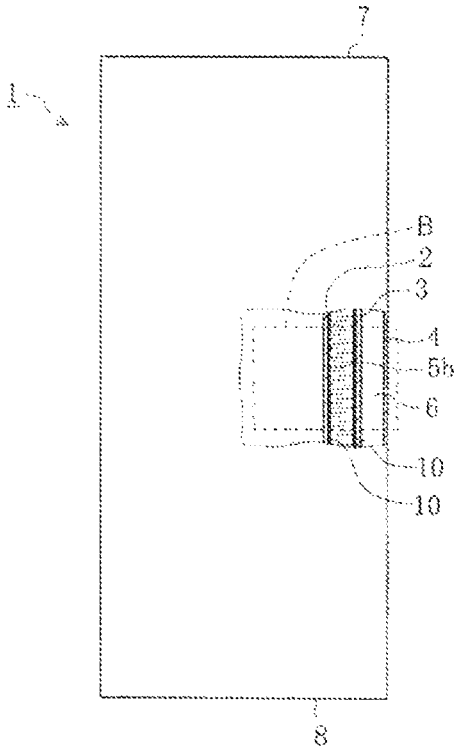

According to the cask 1 which has the above-described construction, gamma rays and neutrons emitted from the radioactive material held in the holding member 2*a* are shielded by the lead layer 5*b* and the neutron shielding material 6. The cut-away portion of FIG. 1B is a sectional view along the line A-A' as seen from a lateral orientation (this also applies to FIG. 3B and FIG. 6B described below).

Figure 2A:
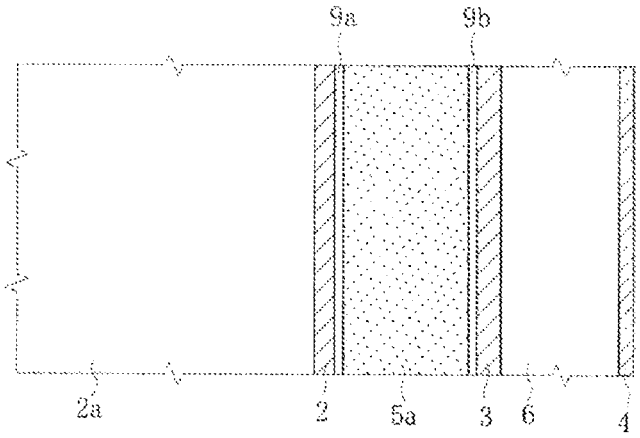
FIGS. 2A and 2B are enlarged views of the characteristic parts of Example 1.
Figure 2B:
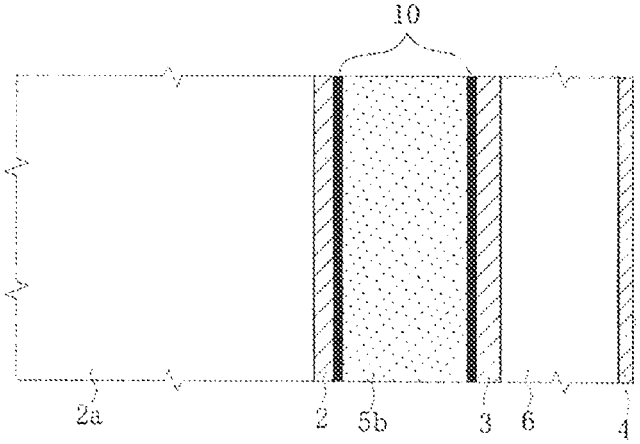

FIGS. 2A and 2B are enlarged views of the rectangular portion marked by the dashed line B in the cut-away portion shown in FIG. 1B (this also applies to FIGS. 4A and 4B, FIGS. 5A and 5B, and FIGS. 7A and 7B described below).

Following is a description of the method of manufacturing the cask 1 according to Example 1. The cask 1 according to Example 1 has a lead layer 5*b* with excellent gamma ray shielding properties formed between the inner shell 2 made from a metal (e.g., a stainless steel such as SUS) and the intermediate shell 3 which is also made also made from a metal (e.g., a stainless steel such as SUS), by pouring molten lead into a space between the inner shell 2 and the intermediate shell 3, and cooling the poured lead 5*a* to solidify it.

Thus, as shown in FIG. 2A, immediately after the poured lead 5*a* cools and solidifies, the resulting state is such that a first void layer 9*a* is formed at the boundary between the inner shell 2 and the poured lead 5*a*, and a second void layer 9*b* is formed at the boundary between the intermediate shell 3 and the poured lead 5*a*.

A gas such as air, for example, that is present inside the first void layer 9*a* and the second void layer 9*b* has a thermal conductivity that is poorer than metal, so this portion forms a heat-insulating layer, causing a reduced heat-dissipating effect in the cask 1.

Accordingly, the method of manufacturing the cask 1 of Example 1 involves pouring a molten lead between the inner shell 2 and the intermediate shell 3 to serve as a gamma ray shielding material, and then using a low melting point metal 10 to fill the first void layer 9*a* formed at the boundary between the inner shell and the poured lead 5*a*, and/or a second void layer 9*b* formed at the boundary between the intermediate shell and the poured lead 5*a*.

In the example shown in FIGS. 2A and 2B, when the molten lead is poured and cooled, not only is the first void layer 9*a* formed, but also the second void layer 9*b* is formed, so the low melting point metal 10 fills both the first void layer 9*a* and the second void layer 9*b*. However, when the molten lead is poured, it is not always the case that the first void layer 9*a* and the second void layer 9*b* are both formed, but instead, there are cases in which only one or the other is formed. In such cases, the low melting point metal 10 should be caused to fill whichever one of the void layers is formed, whether that be the first void layer 9*a* or the second void layer 9*b*.

The present invention places no particular restrictions on the type of low melting point metal 10. However, Al, Pb, Sn, and Zn, or alloys containing these metals can be used, for example.

The low melting point metal 10 that is selected should have a melting point lower than the melting point of lead, so that when the low melting point metal 10 flows in a molten state into the first void layer 9*a* and/or the second void layer 9*b*, it does not cause the solidified lead 5*a*, which has already cooled after being poured, to return to a molten state. If a metal or alloy having a melting point lower than the melting point of lead (327.5° C.) is used as the low melting point metal 10, it is possible for the low melting point metal 10 to flow into the first void layer 9*a* and the second void layer 9*b* at a temperature lower than the melting point of lead.

A soldering alloy can, for example, be used as a low melting point metal 10 having a melting point lower than the melting point of lead. If an Sn—Pb soldering alloy is used, for example, the solidus curve temperature and the liquidus curve temperature vary according to the compounding ratio of Sn, but any of these temperatures are lower than the melting temperature of lead. In particular, if the compounding ratio of Sn in the Sn—Pb soldering alloy is 20% or higher, the solidus curve temperature and the liquidus curve temperature are both lower than 280° C. If a eutectic solder (e.g., Sn 63%-Pb 37%) is used, the solidus curve temperature and the liquidus curve temperature can both be set at 183° C.

In the present invention, it is even more advantageous for the low melting point metal 10 that is selected to have a melting point lower than an allowable temperature of the cask 1 (which is often designed so that the temperature is typically on the order of 150° C., for example). If the melting point of the low melting point metal 10 is set below the allowable temperature of the cask 1, a portion of the low melting point metal 10 can become molten and liquefied, and in a state in which it can typically be used with ensured safety.

If the low melting point metal 10 has a melting point lower than an allowable temperature of the cask 1, it is possible to have a portion of the low melting point metal 10 be in a liquefied state when the cask 1 starts to be used, holding the radioactive material in the holding member 2*a*. Accordingly, if the low melting point metal 10 has a melting point lower than the allowable temperature of the cask 1, then it also becomes possible to absorb slight deformations that result from differences in the thermal expansion ratio of the inner shell 2, the intermediate shell 3, and a lead layer 5. This makes it possible to further increase the adhesion between the inner shell 2 and the lead layer 5, or between the intermediate shell 3 and the lead layer 5, so as to support a state of firm adhesion. This also makes it possible to further enhance the heat-dissipating effect of the cask 1.

In detail, a low melting point solder can be used, for example, as the low melting point metal 10 that has a melting point lower than the allowable temperature (e.g., 150° C.) of the cask 1. For example, if an Sn—Pb—Bi low melting point solder (28.5 Sn—Pb-28.5 Bi) is used, the solidus curve temperature is 99° C. and the liquidus curve temperature is 139° C.

It is also advantageous for the low melting point metal 10 to be a metal or alloy that is a liquid at a normal temperature. If the low melting point metal 10 is a liquid at a normal temperature, then a portion of the low melting point metal 10 will always be in a liquid state, regardless of whether or not the holding member 2*a* contains a radioactive material. Consequently, there is always a high adhesion between the shell 2 and the lead layer 5, or between the intermediate shell 3 and the lead layer 5. In addition, the heat-dissipating effect of the cask 1 is further enhanced, because it is possible to absorb slight deformations that result from differences in the thermal expansion ratio of the inner shell 2, the intermediate shell 3, and a lead layer 5.

A specific example of a metal that can be used as the low melting point metal 10 is silver, which is a liquid at a normal temperature. In this context, the term "normal temperature" follows the definition given in JIS Z 8703, wherein a normal temperature is in a range of 20° C.±15° C. (i.e., 5° C. to 35° C.).

Homogenization treatment, which involves inefficient manual labor, is not used at all in the cask 1 of Example 1, so the cask manufacturing time can be shortened and the manufacturing cost can be reduced.

Figure 3A:
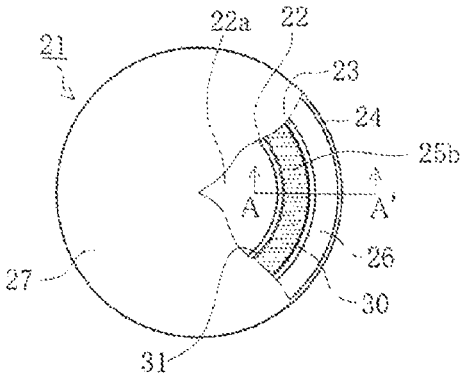
FIGS. 3A and 3B are drawings illustrating the structure of a cask according to Example 2.
Figure 3B:
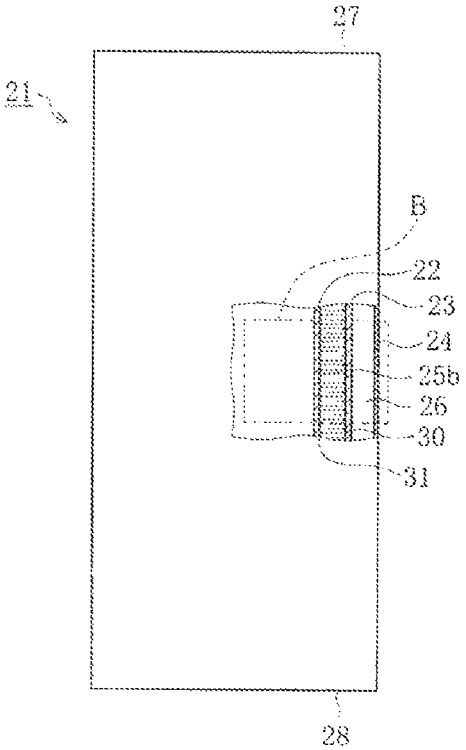

Following is a description of the construction of a cask 21 according to Example 2 shown in FIGS. 3A and 3B, with a focus on the points that differ from Example 1.

As shown in FIGS. 3A and 3B, the cask 21 according to Example 2 has a cylindrical inner shell 22, a cylindrical intermediate shell 23 disposed so as to cover an outer side of the inner shell 22, as well as an outer shell 24 disposed so as to cover an outer side of the intermediate shell 23. A holding member 22*a* that is able to hold radioactive material is provided inside the inner shell 22. A cover 27 that freely opens and closes is provided at the upper end of the cask 21. The lower end of the cask 21 is sealed shut with a bottom plate 28.

A lead layer 25*b* is formed as a gamma ray shielding material formed between the inner shell 22 made from a metal (e.g., a stainless steel such as SUS) and the intermediate shell 23 which is also made from a metal (e.g., a stainless steel such as SUS). A neutron shield material 26 (e.g., silicone rubber) fills a space between the intermediate shell 23 and the outer shell 24. These points are the same as in the cask 1 of Example 1.

The point of difference between Example 1 and the manufacturing method of cask 21 according to Example 2 is that in the cask 21 according to Example 2, before pouring molten lead between the inner shell 22 and the intermediate shell 23, a homogenization treatment is performed on only one of either an outer surface of the inner shell 22 or on an inner surface of the intermediate shell 23. It should be noted that FIGS. 3A and 3B illustrates an example in which homogenization treatment is performed on only an outer surface the inner shell 22.

Figure 4A:
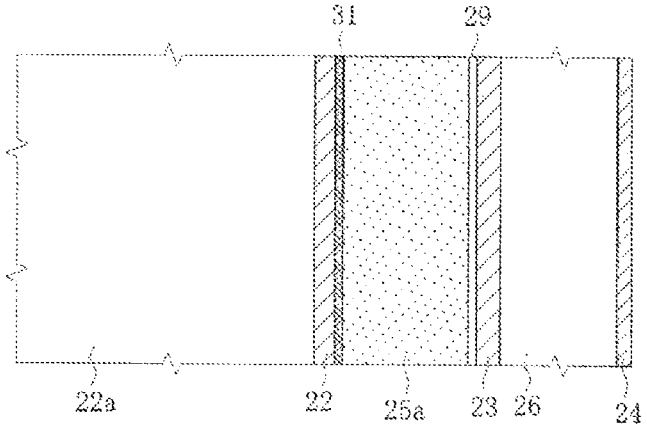
FIGS. 4A and 4B are enlarged views of the characteristic parts of Example 2.

In the above example, as shown in FIG. 4A, a void layer is not present at the boundary between the inner shell 22 and a poured lead 25*a* when the poured lead 25*a* has solidified, because the adhesion is increased due to the effect of a homogenization-treated portion 31.

Figure 4B:
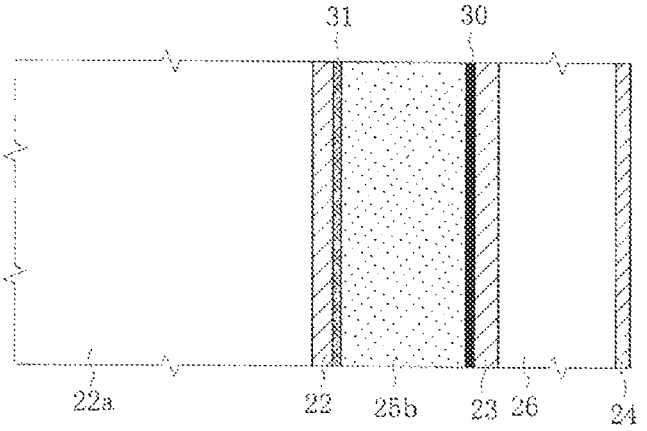

Accordingly, in producing the cask 21 of Example 2, a manufacturing method is employed in which homogenization treatment is performed on only one of either the outer surface of the inner shell 22 or on the inner surface of the intermediate shell 23, and molten lead is poured between the inner shell 22 and the intermediate shell 23 as a gamma ray shielding material, and then the led is allowed to cool. After that, as shown in FIG. 4B, a void layer 29 is filled with a low melting point metal 30 in a closely adhering state, the void being formed at a boundary between the outer surface of the inner shell 22 or the inner surface of the intermediate shell 23, whichever surface is not homogenization treated (the inner surface of the intermediate shell 23 in the above example).

Figure 5A:
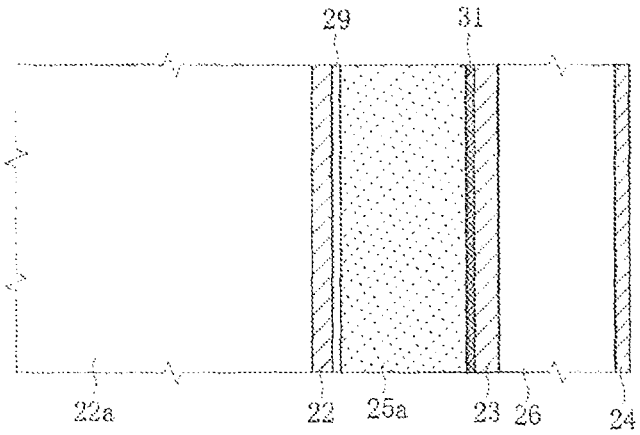
FIGS. 5A and 5B are enlarged views of the characteristic parts of another construction according to Example 2.
Figure 5B:
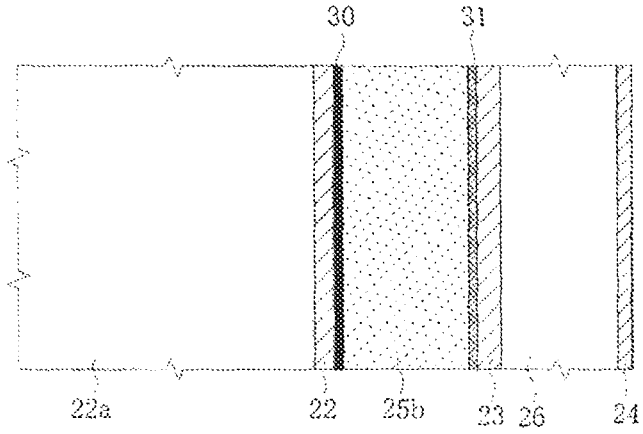

In contrast to the above example, if homogenization treatment is performed only on the inner surface of the intermediate shell 23, as shown in FIGS. 5A and 5B, a void layer 29 is formed only at the boundary between the inner shell 22 and the poured lead 25*a*. Consequently, in this case, only the void layer 29 formed on the side of the inner shell 22 is filled with the low melting point metal 30 in a closely adhering state. The description of the low melting point metal 30 does not particularly differ from that of Example 1, so it is omitted.

Even if the cask 21 of Example 2 undergoes homogenization treatment, void layers are prevented only on one of either the outer surface of the inner shell 22 or the inner surface of the intermediate shell 23. Therefore, the cask manufacturing time and the manufacturing cost can be reduced to a certain extent, but not to the extent as in the cask 1 of Example 1.

Figure 6A:
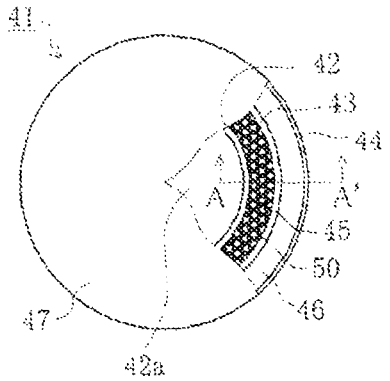
FIGS. 6A and 6B are drawings illustrating the structure of the cask according to Example 3.
Figure 6B:
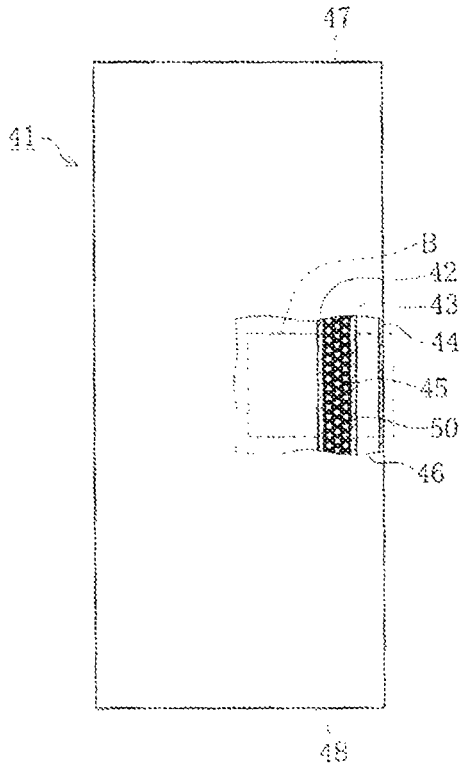

Following is a description of the construction of a cask 41 according to Example 3 shown in FIGS. 6A and 6B, with a focus on the points that differ from Example 2.

As shown in FIGS. 6A and 6B, the cask 41 also has a cylindrical inner shell 42, a cylindrical intermediate shell 43 disposed so as to cover an outer side of the inner shell 42, as well as an outer shell 44 disposed so as to cover an outer shell of the intermediate shell 43. A holding member 42*a* that is able to hold radioactive material is provided inside the inner shell 42, a cover 7 that freely opens and closes is provided at the upper end of the cask 41, the lower end of the cask 41 is sealed shut with a bottom plate 48, and a neutron shield material 46 (e.g., silicone rubber) fills a space between the intermediate shell 43 and the outer shell 44. These points are the same as in Examples 1 and 2.

The method of manufacturing the cask 41 according to Example 3 differs from that of Example 1 and Example 2 in that in manufacturing the cask 41 according to Example 3, instead of pouring molten lead, a plurality of lead bodies 45, formed beforehand into any desired shape and size, are inserted into a space between the inner shell 42 made from a metal (e.g., SUS) and the intermediate shell 43 which is also made from a metal (e.g., SUS), to serve as a gamma ray shielding material. FIGS. 6A and 6B shows an example in which spherical lead bodies 45 are inserted into the space.

Figure 7A:
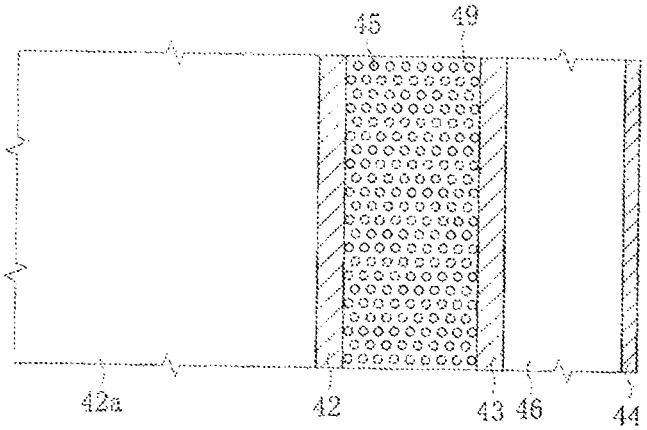
FIGS. 7A and 7B are enlarged views of the characteristic parts of Example 3.

In the above example, as shown in FIG. 7A, immediately after inserting the spherical lead bodies 45 into the space between the inner shell 42 and the intermediate shell 43, the state is such that a void layer 49 is present among the lead bodies 45.

Accordingly, the method of manufacturing the cask 41 of Example 3 involves inserting a plurality of lead bodies 45, formed beforehand into any desired shape and size, into a space between the inner shell 42 and the intermediate shell 43, to serve as a gamma ray shielding material, and then filling the void layer 49 formed between the lead bodies 45 with a low melting point metal 50. The description of the low melting point metal 50 does not particularly differ from that of Examples 1 and 2, so it is omitted.

Figure 7B:
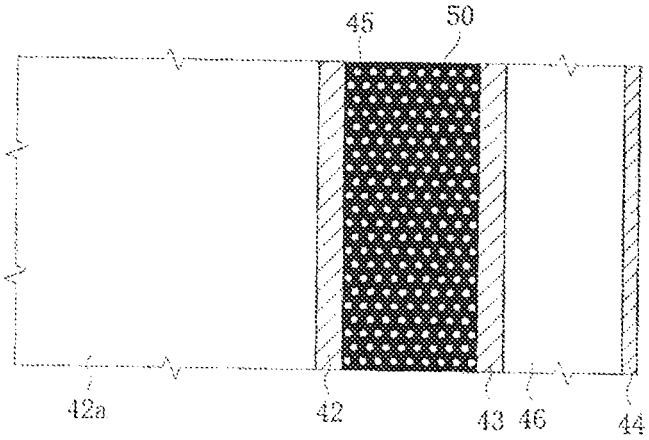

The formed lead bodies inserted between the inner shell 42 and the intermediate shell 43 are not restricted to the spherical shape of the lead bodies 45 shown in FIGS. 7A and 7B. The lead bodies 45 may, for example, be granular, round bar-shaped, regular hexahedral, in the shape of a rectangular parallelepiped, or the like.

If bar-shaped lead bodies are used, they may be inserted in a mutually parallel orientation in the space between the inner shell 42 and the intermediate shell 43, or they may be inserted in blocks arranged in a mutually intersecting orientation.

In Example 3, the void layer 49 formed among the lead bodies 45 may be filled with a good thermal conductivity oil, instead of using the low melting point metal 50. Grease is an example of a good thermal conductivity oil.

Homogenization treatment, which involves inefficient manual labor, is not used at all in the cask 41 of Example 3, so the cask manufacturing time can be shortened and the manufacturing cost can be reduced. It should be noted that if Example 1 and Example 2 are compared, the volume of the void layer 49 becomes large, and it is sufficient to fill the void layer 49 only with the low melting point metal 50 or the good thermal conductivity oil. This means that there is no particular advantage for the void layer 49 to have a large volume. In addition, the cask 41 of Example 3 has good heat dissipating properties.

The above-described casks 1, 21, and 41 that correspond respectively to the inventions according to the claims are able to enhance the heat-dissipating effect of the casks, and can prevent the temperature within the casks from rising. This is achieved by filling the void layers that develop during the manufacturing process with a low melting point metal or a good thermal conductivity oil in a closely adhering state during the latter stages of the manufacturing process.

The following manufacturing method has also been conceived of as a means for making it possible to achieving another construction. In contrast to Example 3 described above, this manufacturing method involves first using the low melting point metal 50 or a good thermal conductivity oil to fill the space between the inner shell 42 and the intermediate shell 43, and then inserting the lead bodies 45.

Even a manufacturing method that reverses this sequence is thought to make it possible to insert the lead bodies 45 into the space between the inner shell 42 and the intermediate shell 43, without utilizing the viscosities of the low melting point metal 50 and the good thermal conductivity oil. A manufacturing method that reverses this sequence is able to utilize the low melting point metal 50, which has a melting point lower than lead, to obtain adhesion within the low melting point metal 50, without melting the lead bodies 45.

The present invention is not limited to the above-described example, and the preferred embodiment may, of course, be advantageously modified within the scope of the technical ideas recited in the claims.

For example, the above embodiments disclose examples in which the inner shell, the intermediate shell, and the outer shell are formed from cylinders, but the inner shell, the intermediate shell, and the outer shell are not limited to this shape, and may be in the shape of a rectangular parallelepiped, for example.

What is claimed is:

1. A containment cask for storage or transport of a radioactive material comprising:

a metallic inner shell;

a metallic intermediate shell disposed on an outer side of the inner shell;

an outer shell disposed so as to cover an outer side of the intermediate shell;

lead solidified from a molten lead poured between the inner shell and the intermediate shell to serve as a gamma ray shielding material; and a low melting point metal filled in either one or both of (i) a first void layer formed at a boundary between the inner shell and the solidified lead or (ii) a second void layer formed at a boundary between the intermediate shell and the solidified lead.

2. A containment cask according to claim 1, wherein the low melting point metal has a melting point lower than the melting point of lead.

3. A containment cask according to claim 1, wherein the low melting point metal has a melting point lower than an allowable temperature of the containment cask for the radioactive material.

4. A containment cask according to claim 1, wherein the low melting point metal is a metal or an alloy in a liquid state at a normal temperature.

5. A containment cask for storage or transport of a radioactive material comprising:

a metallic inner shell;

a metallic intermediate shell disposed on an outer side of the inner shell wherein a homogenization treatment is performed on only one of either an outer surface of the inner shell or on an inner surface of the intermediate shell;

an outer shell disposed so as to cover an outer side of the intermediate shell;

lead solidified from a molten lead poured between the inner shell and the intermediate shell to serve as a gamma ray shielding material; and a low melting point metal filled in a void layer formed at a boundary between the solidified lead and either the outer surface of the inner shell or the inner surface of the intermediate shell, whichever surface was not homogenization treated.

6. A containment cask according to claim 5, wherein the low melting point metal has a melting point lower than the melting point of lead.

7. A containment cask according to claim 5, wherein the low melting point metal has a melting point lower than an allowable temperature of the containment cask for the radioactive material.

8. A containment cask according to claim 5, wherein the low melting point metal is a metal or an alloy in a liquid state at a normal temperature.

9. A containment cask for storage or transport of a radioactive material comprising:

a metallic inner shell;

a metallic intermediate shell disposed on an outer side of the inner shell;

an outer shell disposed so as to cover an outer side of the intermediate shell;

a plurality of lead bodies, formed beforehand into any desired shape and size and inserted into a space between the inner shell and the intermediate shell to serve as a gamma ray shielding material; and a low melting point metal filled in a void layer formed among the lead bodies.

10. A containment cask according to claim 9, wherein the low melting point metal has a melting point lower than the melting point of lead.

11. A containment cask according to claim 9, wherein the low melting point metal has a melting point lower than an allowable temperature of the containment cask for the radioactive material.

12. A containment cask according to claim 9, wherein the low melting point metal is a metal or an alloy in a liquid state at a normal temperature.

13. A containment cask according to claim 9, wherein the void layer formed among the lead bodies is filled with a good thermal conductivity oil, instead of using the low melting point metal.

* * * * *